US009651328B1

(12) United States Patent
Oglesby

(10) Patent No.: US 9,651,328 B1
(45) Date of Patent: May 16, 2017

(54) AMBIDEXTROUS BOLT RELEASE FOR A LOWER RECEIVER

(71) Applicant: Paul A. Oglesby, Darley (GB)

(72) Inventor: Paul A. Oglesby, Darley (GB)

( * ) Notice: Subject to any disclaimer, the term of this patent is extended or adjusted under 35 U.S.C. 154(b) by 0 days.

(21) Appl. No.: 14/987,803

(22) Filed: Jan. 5, 2016

Related U.S. Application Data

(60) Provisional application No. 62/100,196, filed on Jan. 6, 2015.

(51) Int. Cl.
*F41A 19/00* (2006.01)
*F41A 17/42* (2006.01)
*F41A 35/06* (2006.01)

(52) U.S. Cl.
CPC ..... *F41A 17/42* (2013.01); *F41A 35/06* (2013.01)

(58) Field of Classification Search
USPC ..... 42/69.02, 16, 14; 89/138, 153, 152, 180, 89/181, 190
See application file for complete search history.

(56) References Cited

U.S. PATENT DOCUMENTS

| | | | | |
|---|---|---|---|---|
| 8,261,652 | B2 * | 9/2012 | Findlay | F41A 17/36 42/70.02 |
| 8,695,477 | B2 * | 4/2014 | Esch | F41A 17/42 42/14 |
| 2012/0167424 | A1 * | 7/2012 | Gomez | F41A 35/06 42/14 |
| 2016/0116242 | A1 * | 4/2016 | McGinty | F41A 35/06 42/16 |
| 2016/0258696 | A1 * | 9/2016 | Fluhr | F41A 17/36 |

* cited by examiner

*Primary Examiner* — J. Woodrow Eldred
(74) *Attorney, Agent, or Firm* — Shaddock Law Group, PC

(57) ABSTRACT

An ambidextrous bolt release that includes an ambidextrous bolt release lever; a bolt catch pivotable about a bolt catch pivot aperture between a bolt engagement and a bolt release position, wherein the bolt catch comprises a bolt engagement projection, and wherein the bolt catch comprises a bolt catch projection; and a connector bar extending from a first into a second end and attached or coupled between the ambidextrous bolt release lever and the bolt catch, such that vertical movement of the ambidextrous bolt release lever results in vertical movement of the connector bar and rotation of the bolt catch.

20 Claims, 14 Drawing Sheets

AMBIDEXTROUS BOLT RELEASE FOR A LOWER RECEIVER

CROSS-REFERENCE TO RELATED APPLICATIONS

This patent application claims the benefit of U.S. Patent Application Ser. No. 62/100,196, filed Jan. 6, 2015, the entire disclosure of which is incorporated herein by reference.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to an ambidextrous lower receiver and ambidextrous bolt release assembly adaptable to be used with a firearm, such as the AR-15, M4, and the like.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms, include a pushbutton magazine release found on one side of the firearm—typically the right side. Oftentimes, the magazine release button is at least partially protected by one or more ridges that reduce the chances of inadvertent activation.

The magazine release button is typically attached or coupled to a magazine release, which includes a magazine engagement projection that releasably engages a portion of a magazine, when the magazine is fully inserted within the magazine well of the firearm.

The magazine release includes a magazine release connection shaft that extends from one side of the magazine release. The magazine release connection shaft includes a threaded portion that can be threaded late engaged with the threaded aperture of the magazine release button.

A magazine release spring typically provides spring biasing to the magazine release lever, when installed in the firearm.

The bolt catch is typically pivotably attached or coupled to the lower receiver on a left side, opposite the magazine release button. The bolt catch includes a bolt catch button that can be pressed to pivot the bolt catch about a bolt catch pivot aperture to pivot the bolt catch from a bolt engagement position to a bolt release position. The bolt catch is typically spring biased to the bolt release position.

In the bolt engagement position, the bolt catch is pivoted such that at least a portion of a bolt engagement projection extends in front of the face of the bolt carrier (when the bolt carrier is in a rearward position) and engages the bolt face to maintain the ball carrier in the rearward position.

A magazine biasing projection extends from the so as to interact with a follower in a magazine. In this manner, when an empty magazine is in the firearm, the magazine follower interacts with the magazine biasing projection, to pivot the bolt catch to a bolt engagement position.

When the bolt catch button is depressed, the bolt catch pivots such that the bolt engagement projection is urged downward, away from the face of the bolt carrier, allowing the bolt carrier to move forward.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

However, the standard bolt catch can only be operated from one side of the firearm and does not provide for ambidextrous manipulation. Thus, the ambidextrous bolt release for a lower receiver, as disclosed herein, provide ambidextrous manipulation of the bolt catch through an ambidextrous bolt release lever positioned at least partially within the trigger guard aperture of the firearm.

In various exemplary, non-limiting embodiments, the ambidextrous bolt releases, as disclosed herein, comprise an ambidextrous bolt release comprising an ambidextrous bolt release system that includes an ambidextrous bolt release lever; a bolt catch pivotable about a bolt catch pivot aperture between a bolt engagement and a bolt release position, wherein the bolt catch comprises a bolt engagement projection, and wherein the bolt catch comprises a bolt catch projection; and a connector bar extending from a first into a second end and attached or coupled between the ambidextrous bolt release lever and the bolt catch, such that vertical movement of the ambidextrous bolt release lever results in vertical movement of the connector bar and rotation of the bolt catch.

In various exemplary, nonlimiting embodiments, the connector bar is attached or coupled to the bolt catch via interaction of a connector bar hook of the connector bar and a bolt catch projection of the bolt catch.

In various exemplary, nonlimiting embodiments, the connector bar is attached or coupled to the ambidextrous bolt release lever via interaction of a connector bar primary recess of the connector bar and a lever projection of the ambidextrous bolt release lever.

In various exemplary, nonlimiting embodiments, the ambidextrous bolt release lever is spring biased via interaction of a biasing rod and a biasing spring on a shoulder of the connector bar.

In various exemplary, nonlimiting embodiments, the ambidextrous bolt release lever is positioned within at least a portion of a trigger guard aperture of a firearm.

Accordingly, the present disclosure provides an ambidextrous bolt release that allows a user to manipulate the bolt catch from either side of the lower receiver.

The present disclosure separately provides an ambidextrous bolt release that allows a user to optionally manipulate the bolt catch in a known fashion.

The present disclosure separately provides an ambidextrous bolt release that allows a user to lock the bolt back as well as send it forward in an ambidextrous fashion.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures.

While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the present disclosure. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary and the present disclosure may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the presently disclosed systems, methods, and/or apparatuses.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
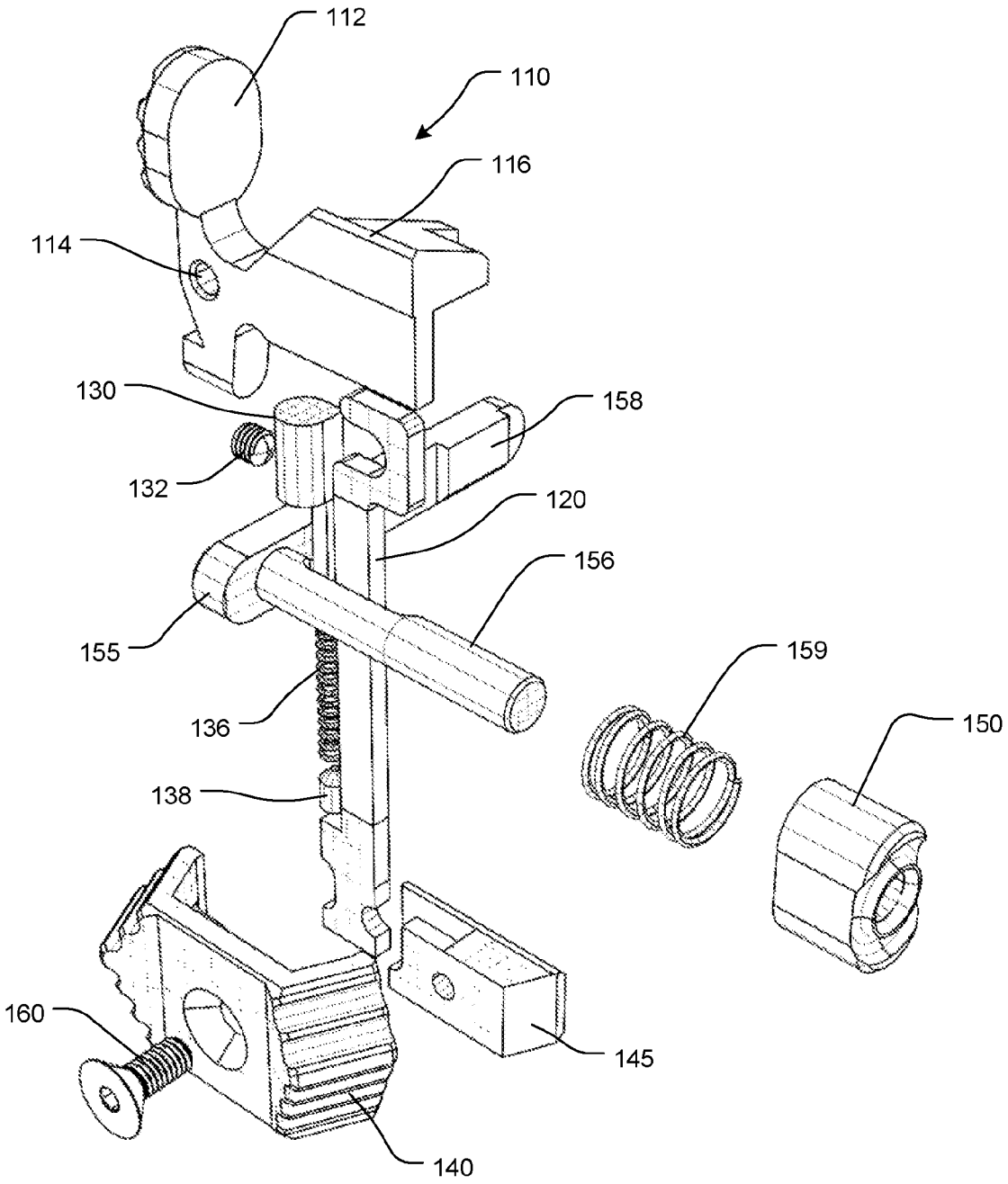
FIG. 1 illustrates an exploded, right, rear perspective view of certain components of an ambidextrous bolt release system, according to the present disclosure.

For simplicity and clarification, the design factors and operating principles of the ambidextrous bolt release according to the present disclosure are explained with reference to various exemplary embodiments of an ambidextrous bolt release according to the present disclosure. The basic explanation of the design factors and operating principles of the ambidextrous bolt release is applicable for the understanding, design, and operation of the ambidextrous bolt release of the presently disclosed systems, methods, and/or apparatuses. It should be appreciated that the ambidextrous bolt release can be adapted to many applications where an attachment/anti-rotation system can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "ambidextrous", "ambidextrous bolt release", "ambidextrous bolt release system", and "lower receiver" are used for basic explanation and understanding of the operation of the systems, methods, and apparatuses of this disclosure. Therefore, the terms "ambidextrous", "ambidextrous bolt release", "ambidextrous bolt release system", and "lower receiver" are not to be construed as limiting the systems, methods, and apparatuses of this disclosure.

For simplicity and clarification, the ambidextrous bolt release of this disclosure will be described as being used in conjunction with the upper receiver of a firearm, such as an AR-15 or M4 style rifle or carbine. However, it should be appreciated that these are merely exemplary embodiments of the ambidextrous bolt release and are not to be construed as limiting this disclosure.

Figure 2:
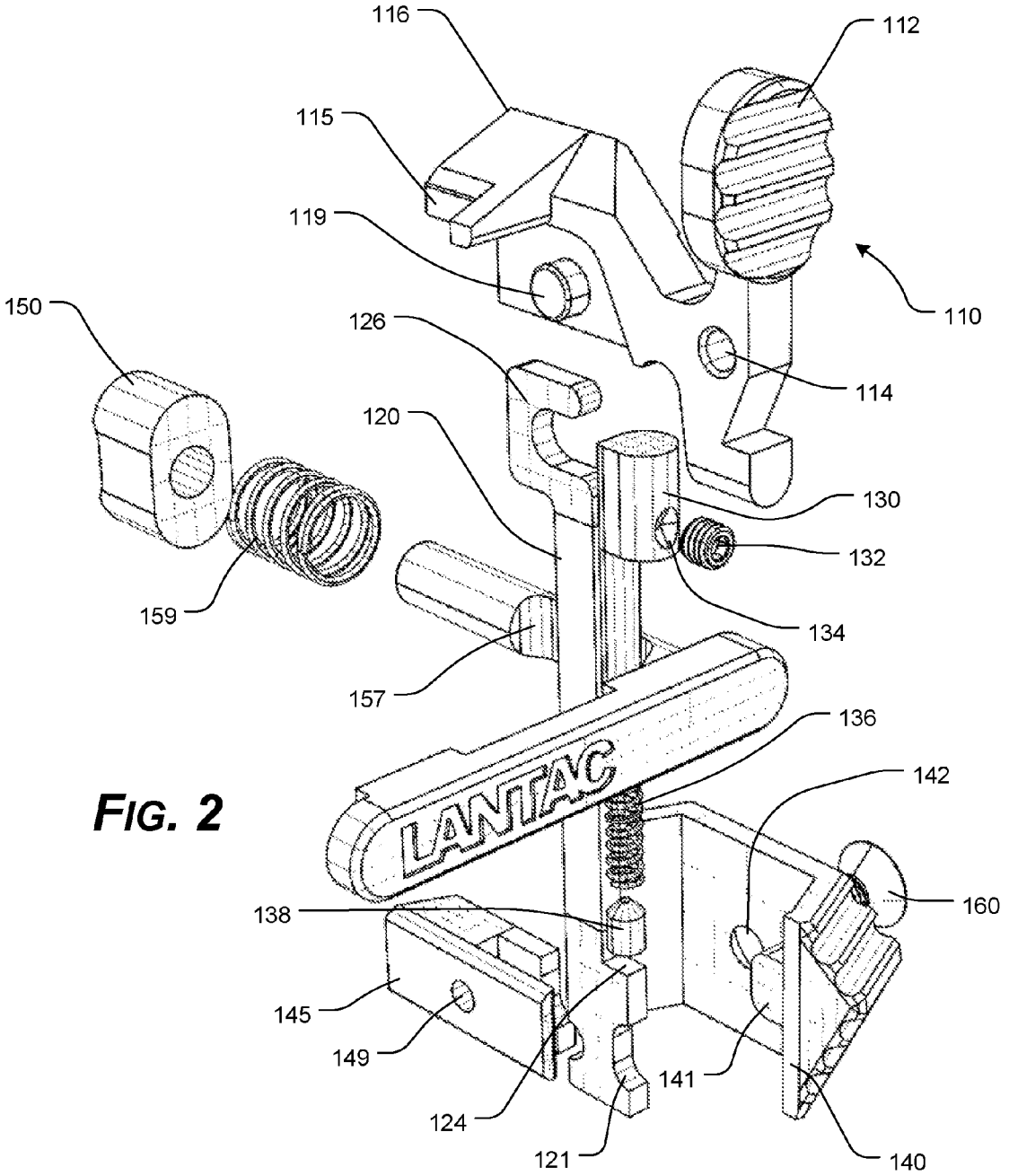
FIG. 2 illustrates an exploded, left, front perspective view of certain components of an ambidextrous bolt release system, according to the present disclosure.
Figure 3:
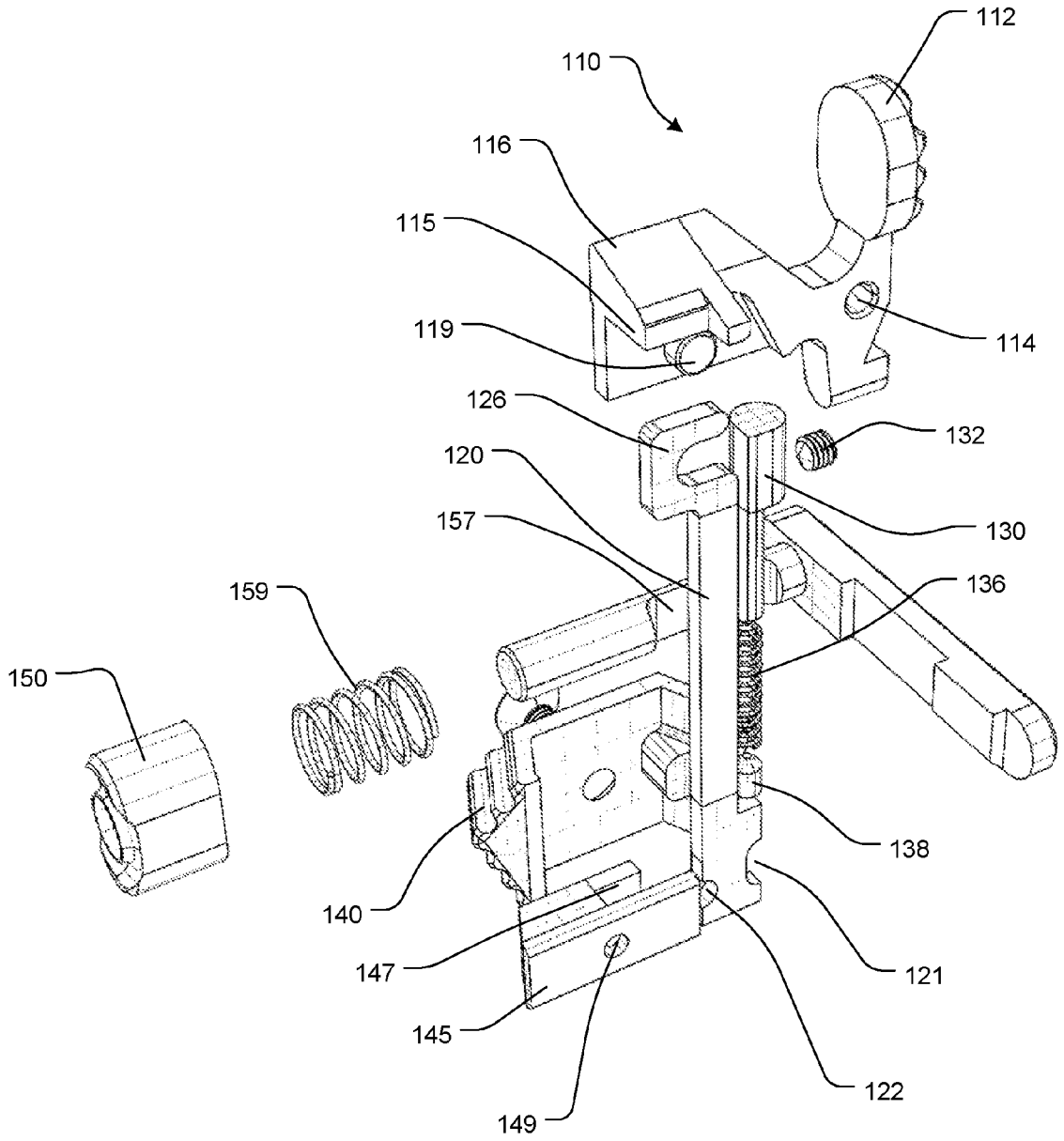
FIG. 3 illustrates an exploded, right, front perspective view of certain components of an ambidextrous bolt release system, according to the present disclosure.
Figure 4:
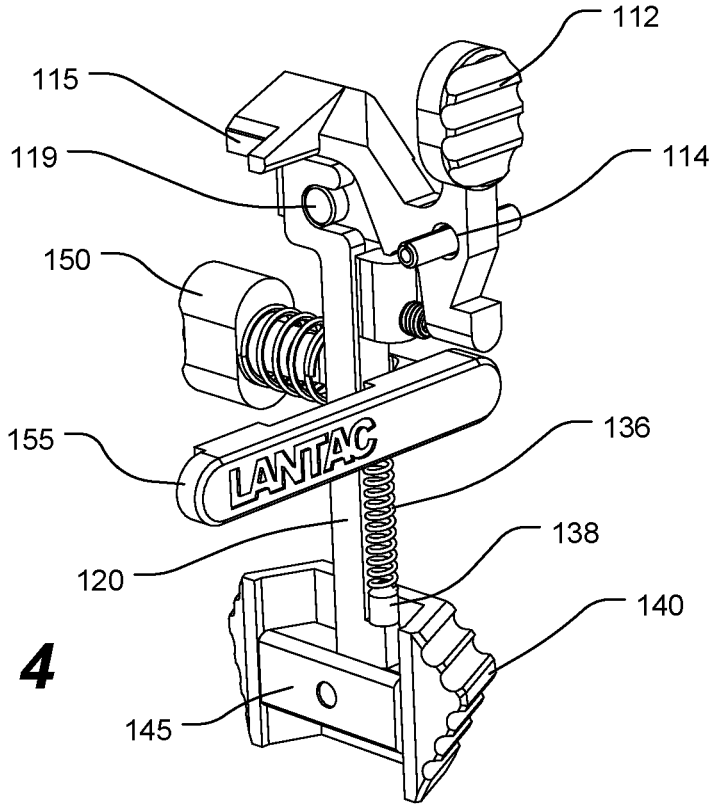
FIG. 4 illustrates a left, front perspective view of certain assembled components of an ambidextrous bolt release system, according to the present disclosure.
Figure 5:
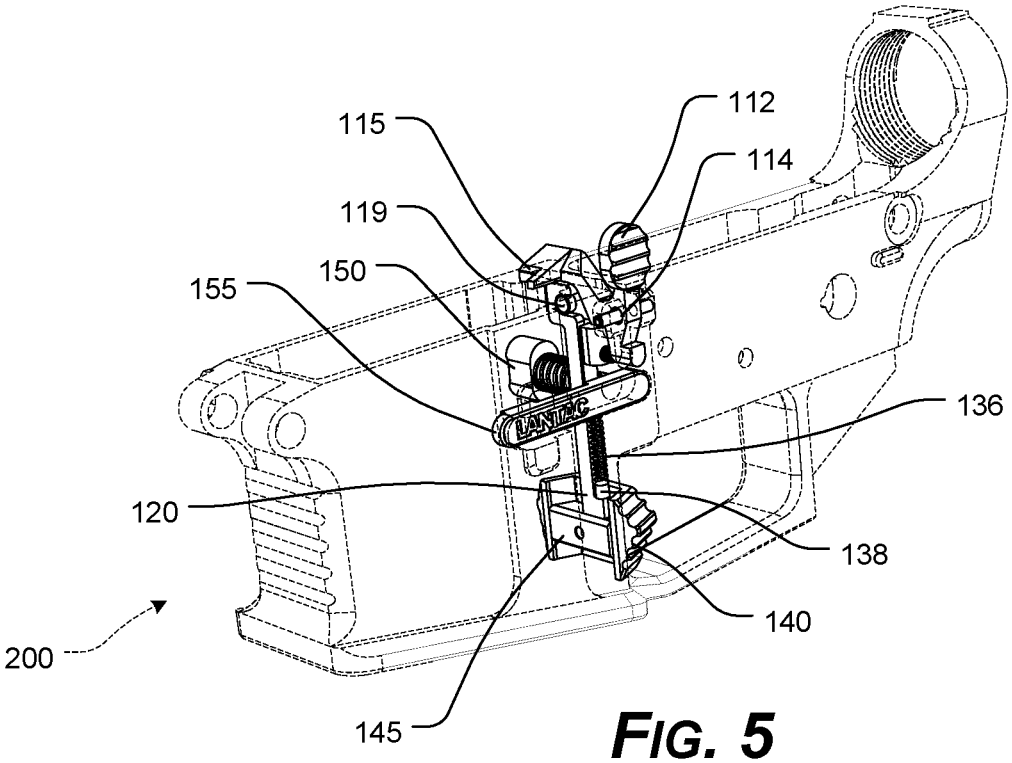
FIG. 5 illustrates a left, front perspective view of certain assembled components of an ambidextrous bolt release system within a lower receiver, according to the present disclosure.
Figure 6:
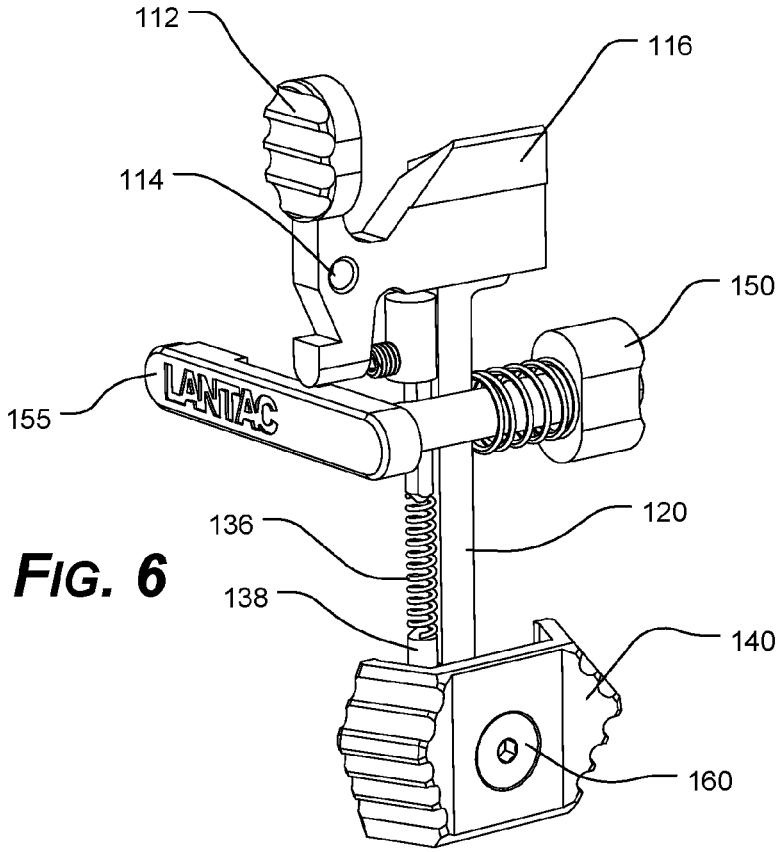
FIG. 6 illustrates a left, rear perspective view of certain assembled components of an ambidextrous bolt release system, according to the present disclosure.
Figure 7:
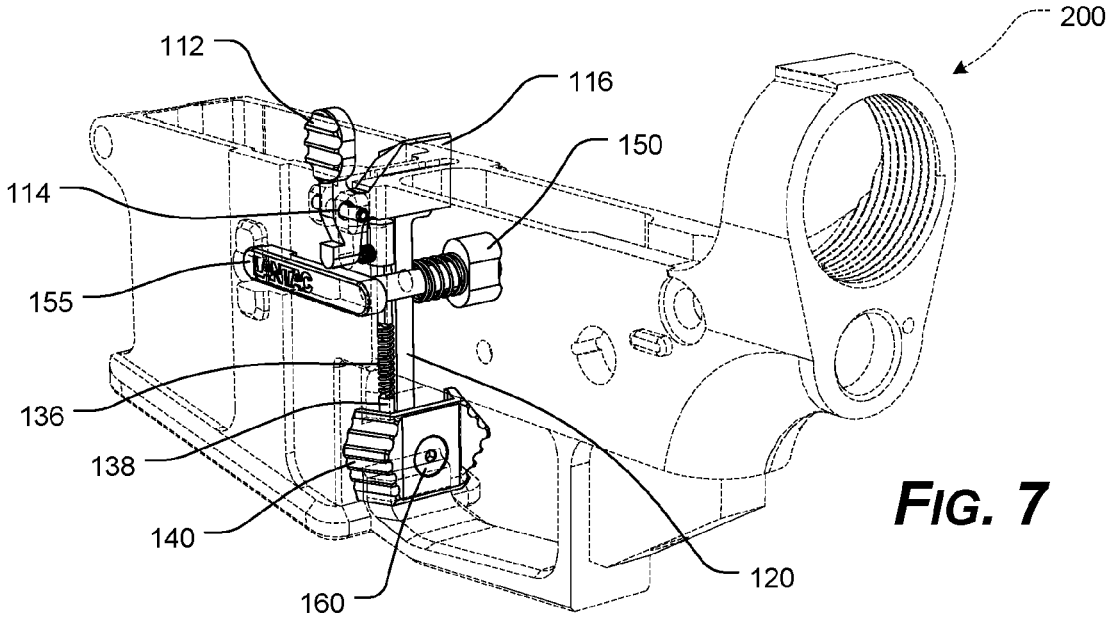
FIG. 7 illustrates a left, rear perspective view of certain assembled components of an ambidextrous bolt release system within a lower receiver, according to the present disclosure.
Figure 8:
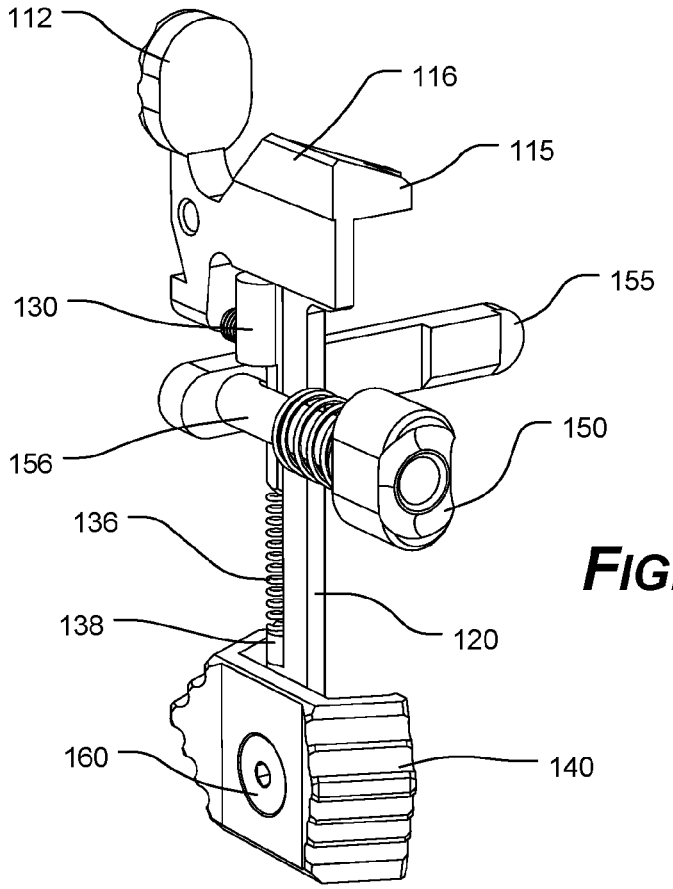
FIG. 8 illustrates a right, rear perspective view of certain assembled components of an ambidextrous bolt release system, according to the present disclosure.
Figure 9:
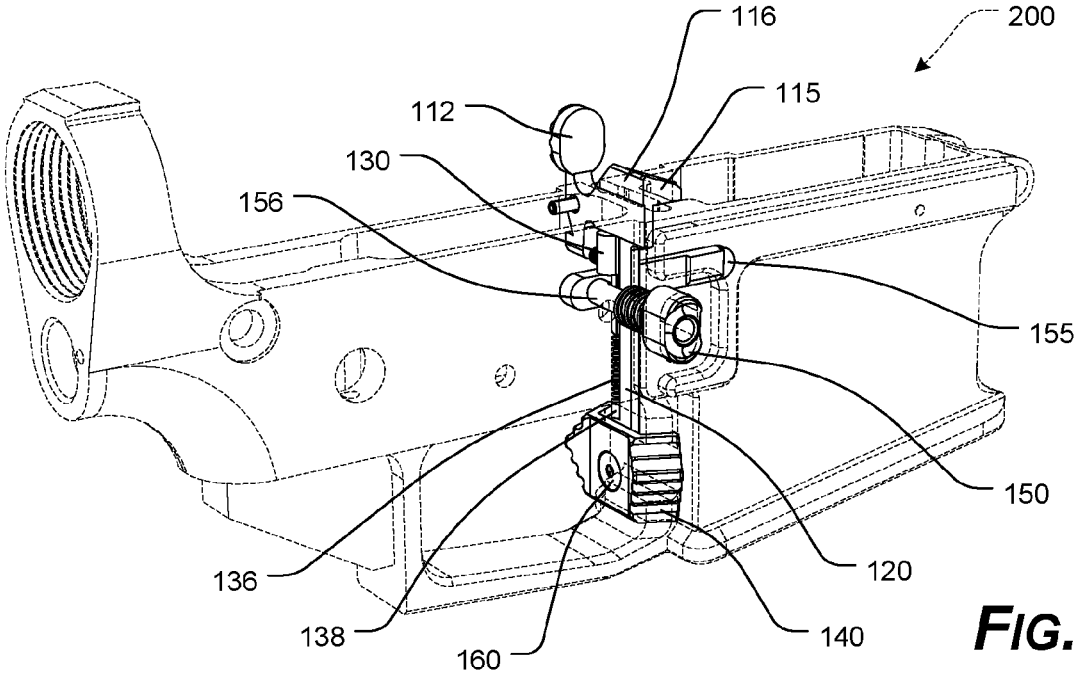
FIG. 9 illustrates a right, rear perspective view of certain assembled components of an ambidextrous bolt release system within a lower receiver, according to the present disclosure.
Figure 10:
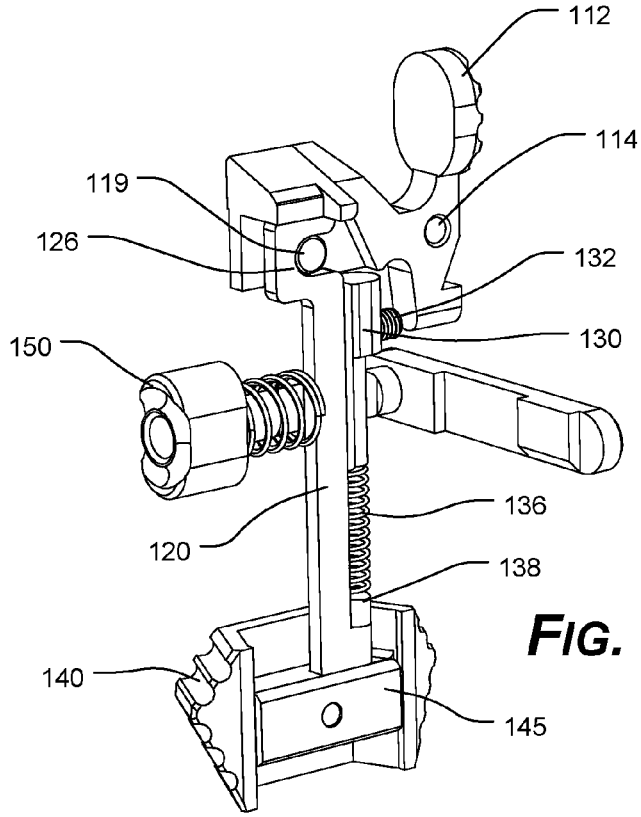
FIG. 10 illustrates a right, front perspective view of certain assembled components of an ambidextrous bolt release system, according to the present disclosure.
Figure 11:
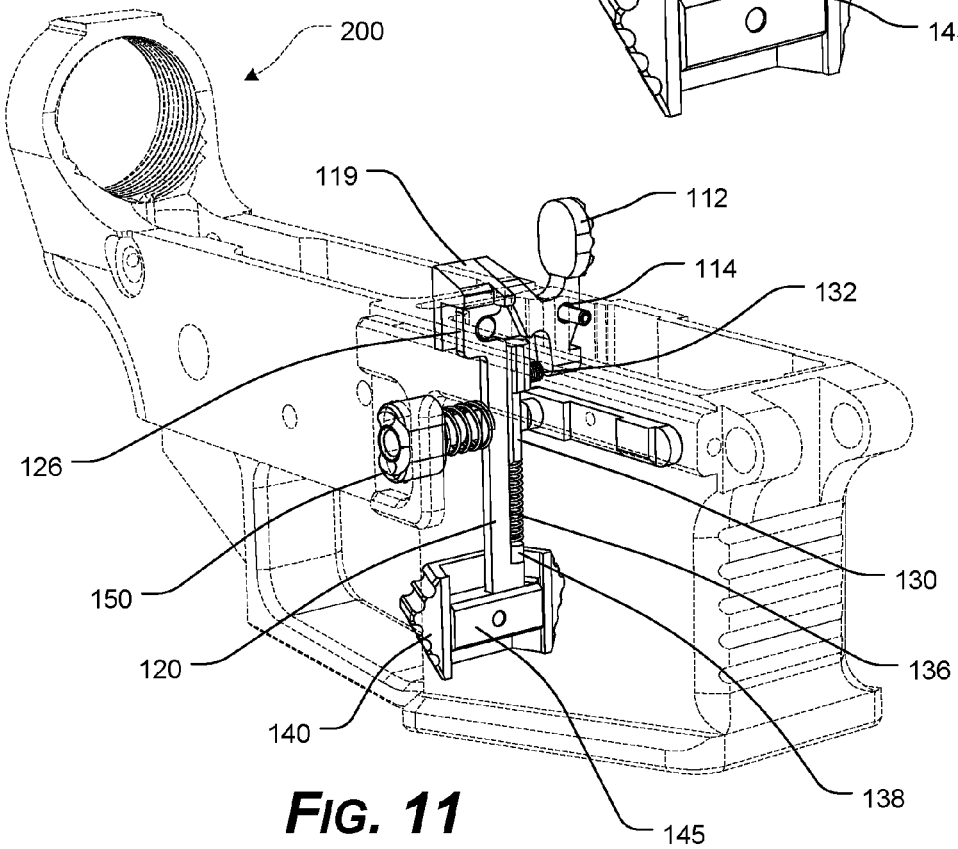
FIG. 11 illustrates a right, front perspective view of certain assembled components of an ambidextrous bolt release system within a lower receiver, according to the present disclosure.
Figure 12:
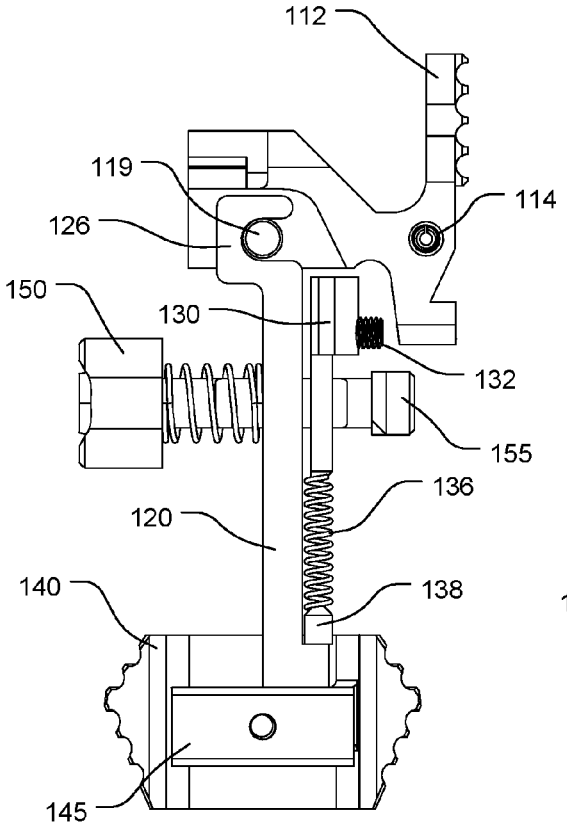
FIG. 12 illustrates a front view of certain assembled components of an ambidextrous bolt release system, wherein the bolt release is in a bolt release position, according to the present disclosure.
Figure 13:
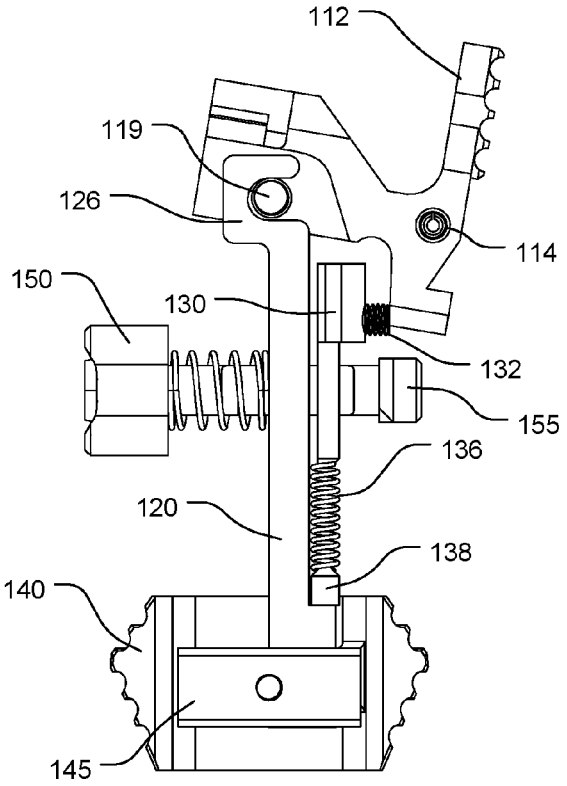
FIG. 13 illustrates a front view of certain assembled components of an ambidextrous bolt release system, wherein the bolt release is in a bolt engagement position, according to the present disclosure.
Figure 14:
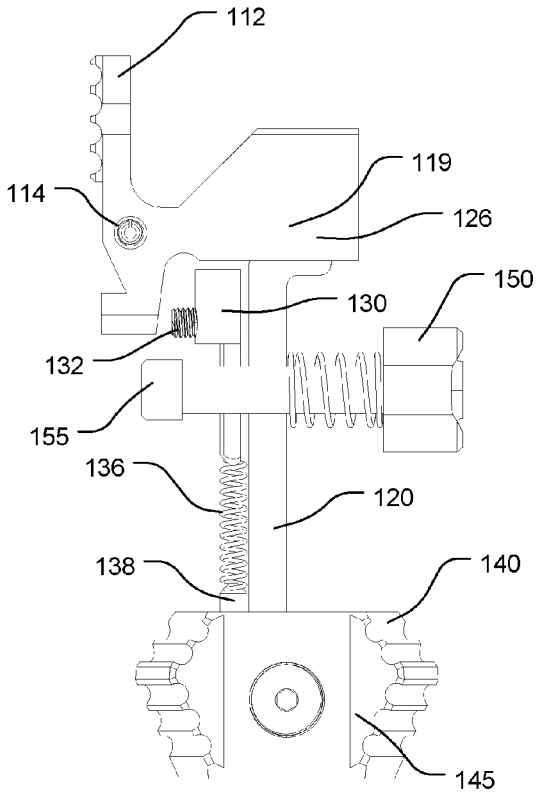
FIG. 14 illustrates a rear view of certain assembled components of an ambidextrous bolt release system, wherein the bolt release is in a bolt release position, according to the present disclosure.
Figure 15:
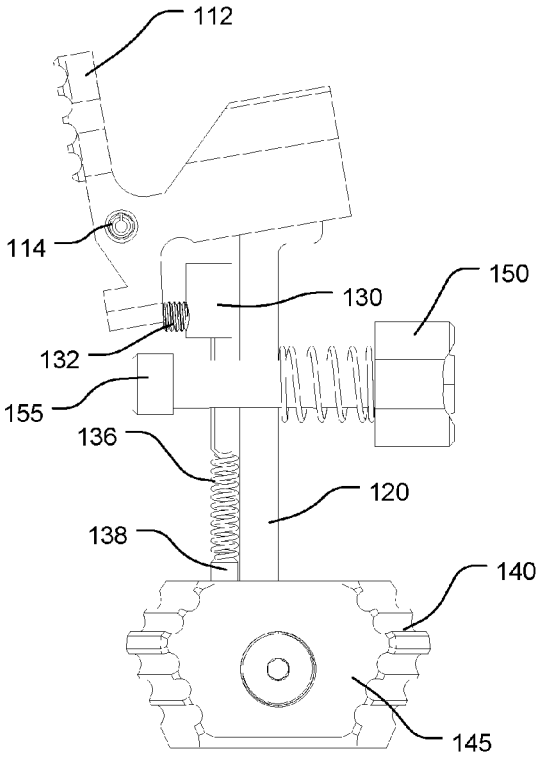
FIG. 15 illustrates a rear view of certain assembled components of an ambidextrous bolt release system, wherein the bolt release is in a bolt engagement position, according to the present disclosure.
Figure 16:
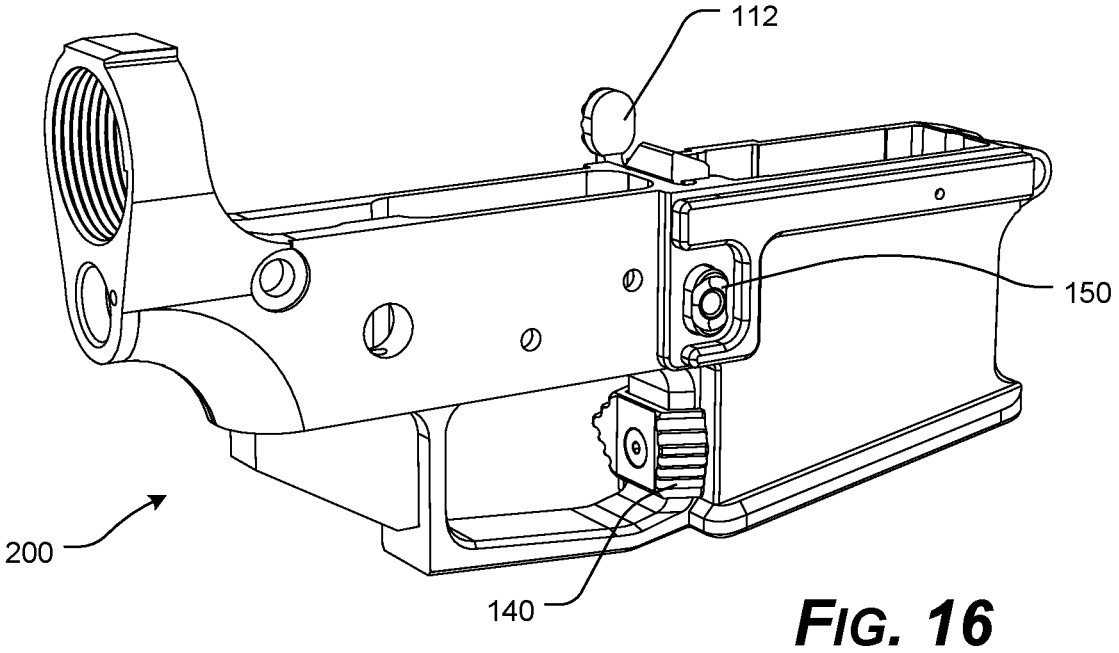
FIG. 16 illustrates a right, rear perspective view of certain assembled components of an ambidextrous bolt release system within a lower receiver, according to the present disclosure.
Figure 17:
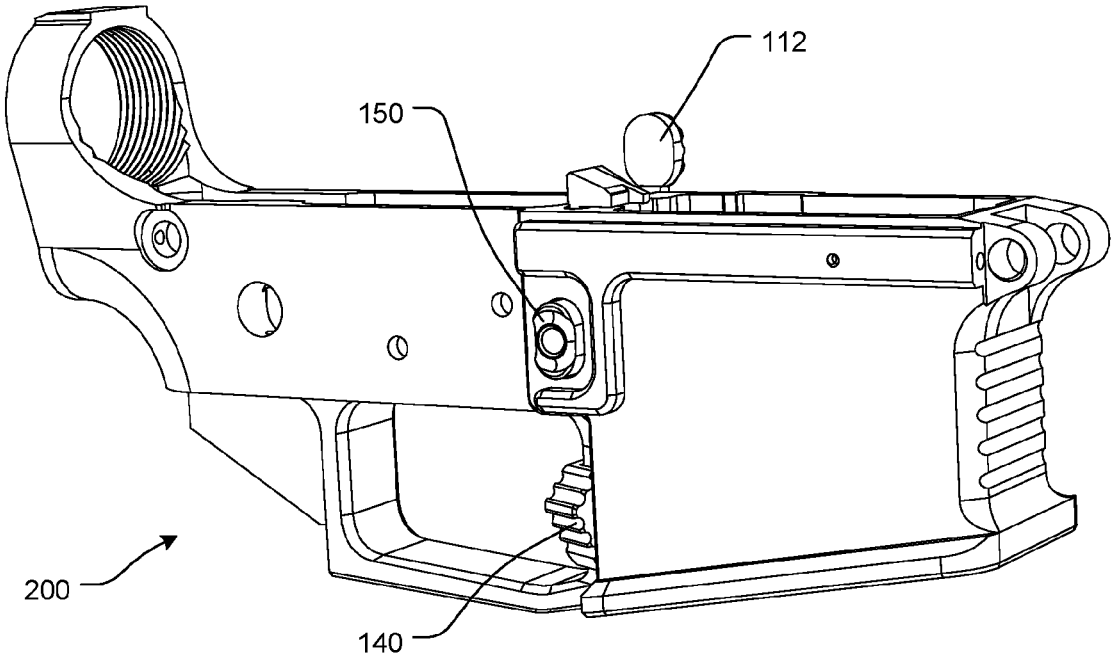
FIG. 17 illustrates a right, front perspective view of certain assembled components of an ambidextrous bolt release system within a lower receiver, according to the present disclosure.
Figure 18:
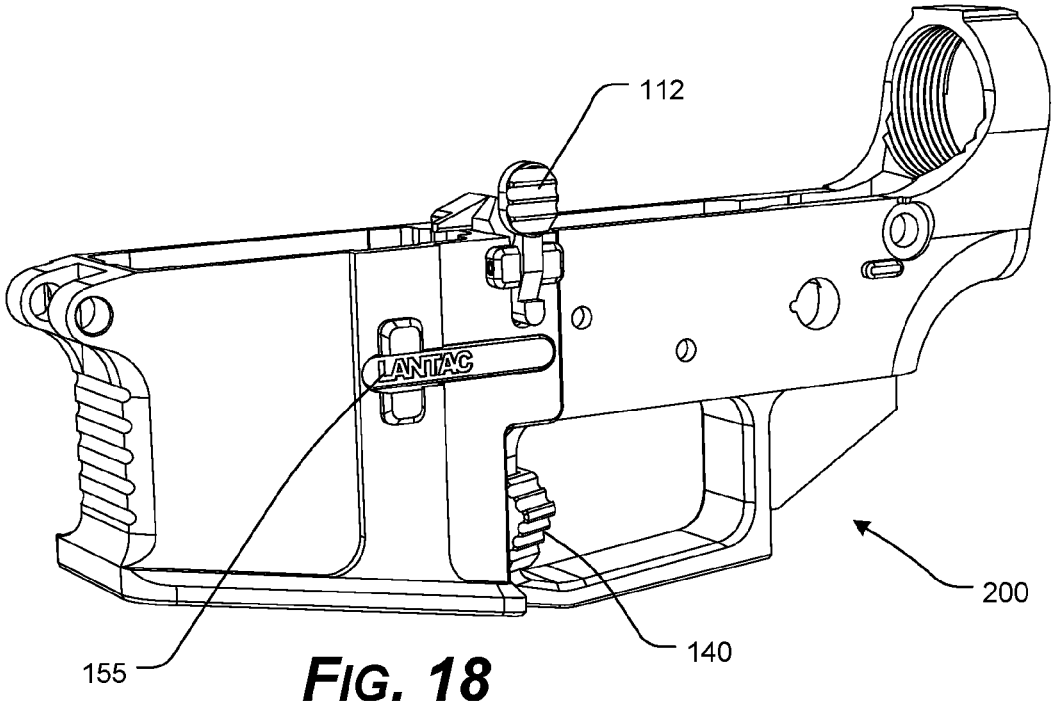
FIG. 18 illustrates a left, front perspective view of certain assembled components of an ambidextrous bolt release system within a lower receiver, according to the present disclosure.
Figure 19:
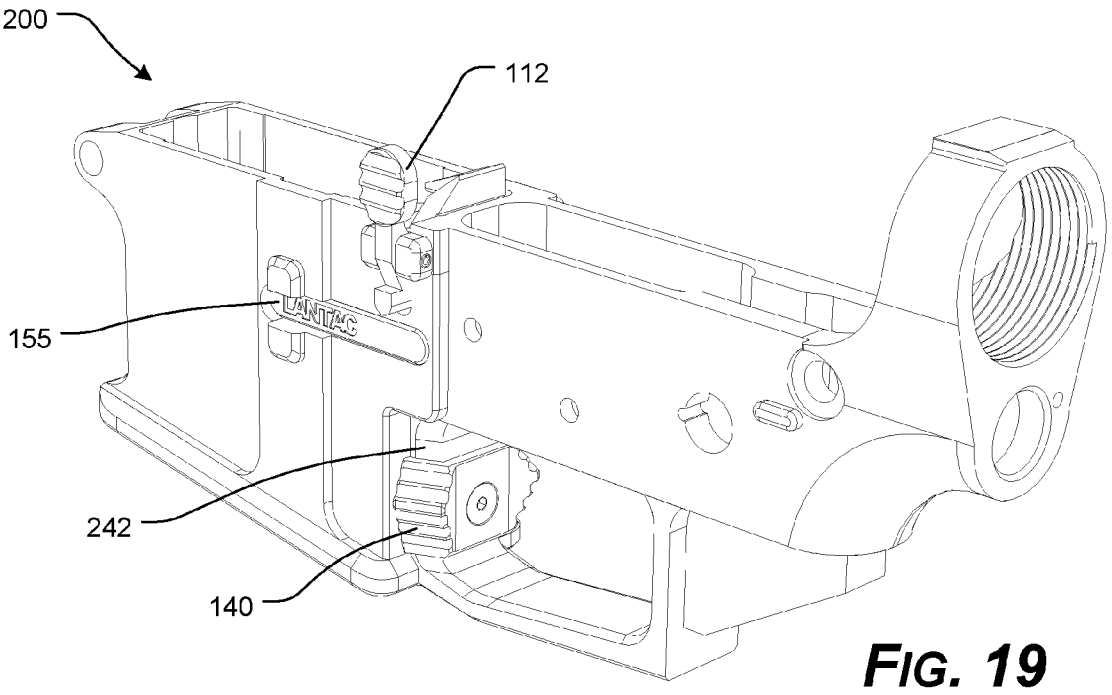
FIG. 19 illustrates a left, rear perspective view of certain assembled components of an ambidextrous bolt release system within a lower receiver, according to the present disclosure.
Figure 20:
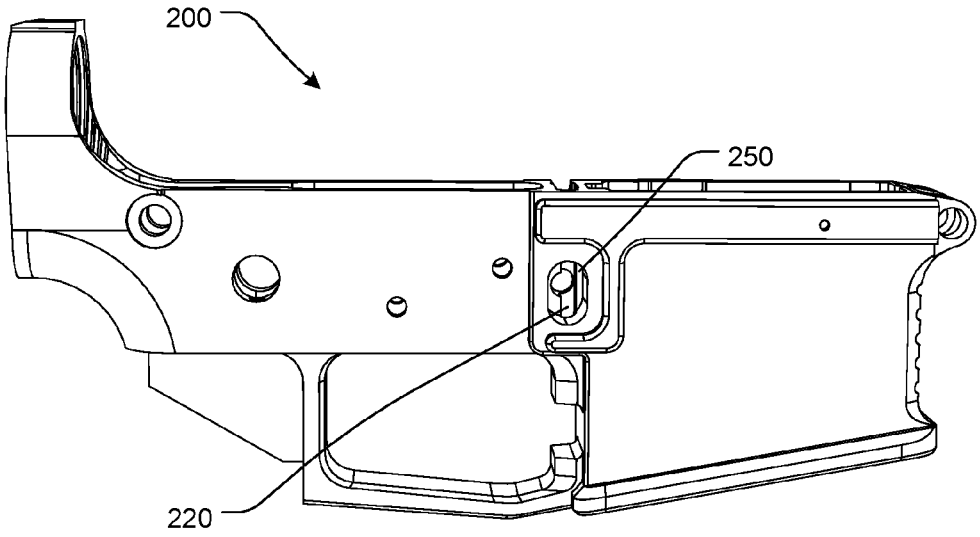
FIG. 20 illustrates a right perspective view of a lower receiver for an ambidextrous bolt release system, according to the present disclosure.
Figure 21:
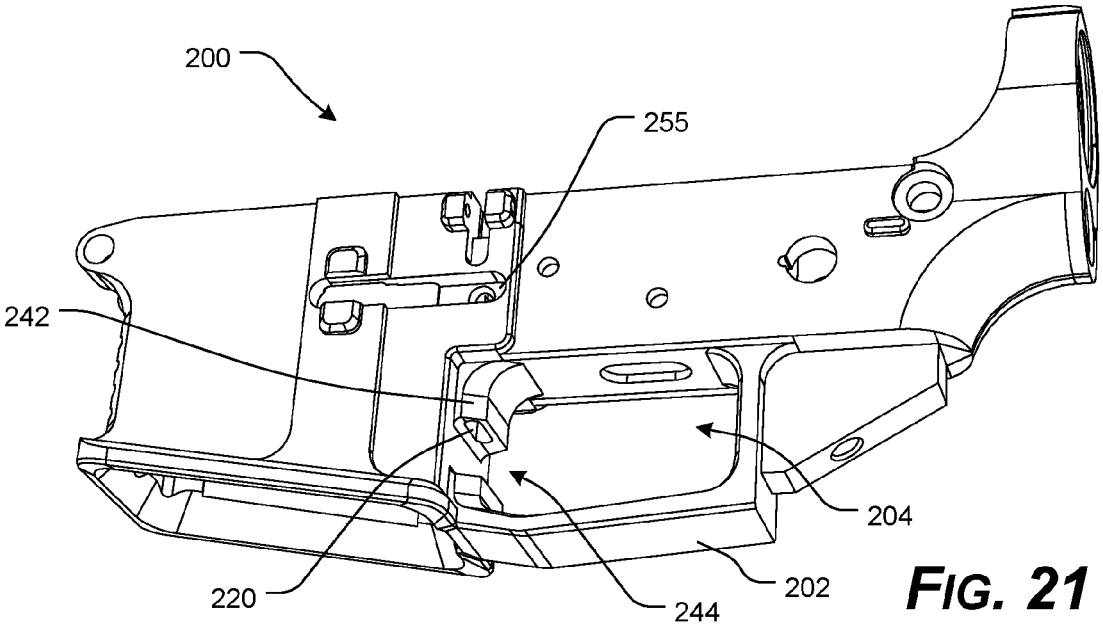
FIG. 21 illustrates a left, lower perspective view of a lower receiver for an ambidextrous bolt release system, according to the present disclosure.
Figure 22:
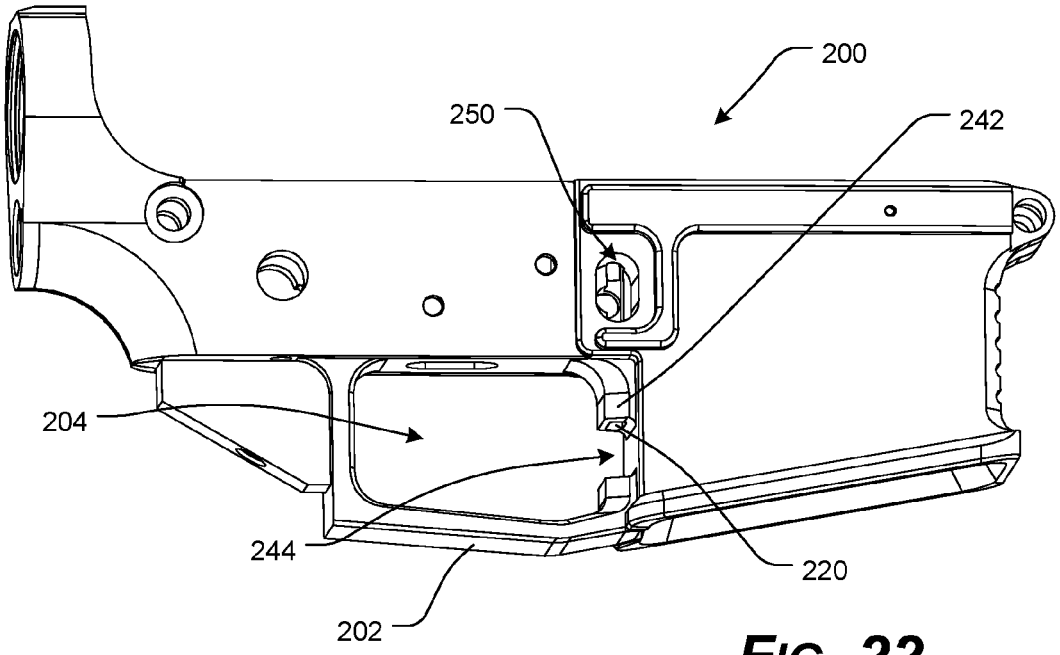
FIG. 22 illustrates a right, lower perspective view of a lower receiver for an ambidextrous bolt release system, according to the present disclosure.
Figure 23:
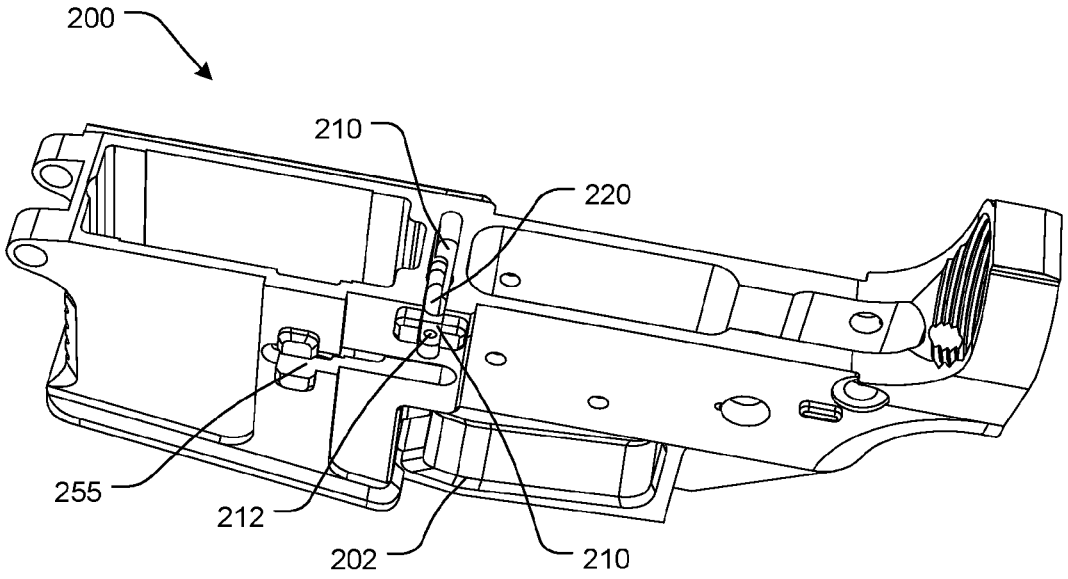
FIG. 23 illustrates an upper, left perspective view of a lower receiver for an ambidextrous bolt release system, according to the present disclosure.
Figure 24:
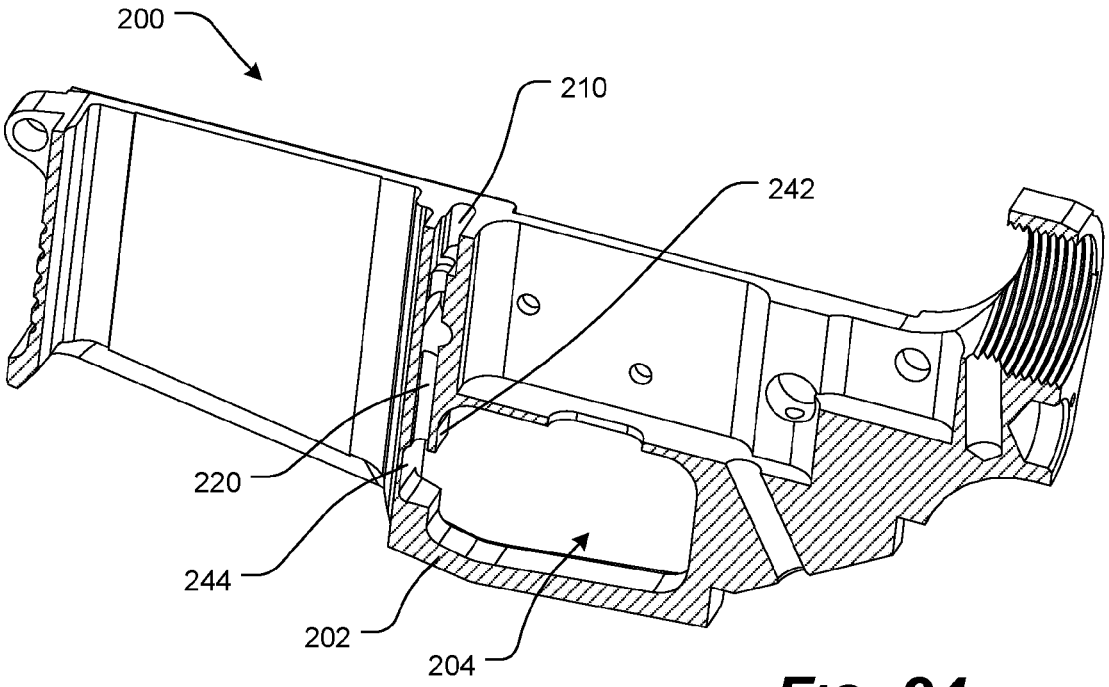
FIG. 24 illustrates an upper, left, cutaway perspective view of a lower receiver for an ambidextrous bolt release system, according to the present disclosure.

Turning now to the drawing Figs., FIGS. 1-24 illustrate certain elements and/or aspects of an exemplary embodiment of an ambidextrous bolt release system 100, according to the present disclosure. As illustrated in FIGS. 1-24, the ambidextrous bolt release system 100 comprises at least some of a bolt catch 110, a connector bar 120, a biasing rod 130, and an ambidextrous bolt release lever 140.

The lower receiver 200 to be used in conjunction with the ambidextrous bolt release system 100 comprises at least some of a trigger guard 202, a trigger guard aperture 204, a bolt catch recess 210, a connector bar channel 220, an ambidextrous bolt release lever guide 242, an ambidextrous bolt release lever recess 244, and a magazine release button recess 250.

The bolt catch 110 comprises at least some of a bolt catch button 112, a bolt engagement projection 116, a magazine biasing projection 115, and a bolt catch pivot aperture 114. It should be appreciated that the bolt catch button 112, the bolt engagement projection 116, the magazine biasing projection 115 and the bolt catch pivot aperture 114 of the bolt catch 110 operates similarly to corresponding elements of known bolt catches.

However, the bolt catch 110 further comprises a bolt catch projection 119. The bolt catch projection 119 extends from a wall surface of the bolt catch 110.

The connector bar 120 extends from a first end portion to a second end portion and comprises a connector bar hook 126 having a connector bar recess 127 formed proximate the first end portion and a first connector bar recess 121 and a second connector bar recess 122 formed proximate the second end portion. The bolt catch projection 119 provides a projection that is capable of interacting with a connector bar aperture, notch, or recess 127 of the connector bar hook 126 of the connector bar 120.

In various exemplary embodiments, the bolt catch projection 119 is substantially cylindrical and the connector bar recess 127 comprises a recess having a substantially circular inner profile that matingly engages the cylindrical bolt catch projection 119. It should be appreciated that the overall profiles of the bolt catch projection 119 and the connector bar recess 127 are design choice and are not limited to a substantially cylindrical configuration. Thus, it should be understood that any desired profile may be used to form the bolt catch projection 119 and the connector bar recess 127 (such as, for example, a rotation pin and a mating rotation aperture), so long as the bolt catch projection 119 and the connector bar recess 127 are capable of slidably, rotatably, or otherwise interacting with one another such that pivotal movement of the bolt catch 110 translates into longitudinal movement of the connector bar 120 and longitudinal movement of the connector bar 120 translates into rotational movement of the bolt catch 110.

In various exemplary embodiments, a shoulder 124 is formed in the connector bar 120, proximate the second end portion, for engaging a biasing spring 136 and/or spring detent 138.

The biasing rod 130 extends from a first end portion to a second end portion and optionally includes a biasing rod dimple or recess 134 formed so as to be at least partially engaged by biasing rod threaded detent 132 for being secured within at least a portion of a bolt catch aperture 210 of the lower receiver 200. In various exemplary, nonlimiting embodiments, the biasing rod threaded detent 132 is secured within at least a portion of the bolt catch aperture 210, via a threaded detent aperture 212. The biasing rod 130 is formed so as to interact with the biasing spring 136 and provide at least a contact surface for the biasing spring 136.

In various exemplary embodiments, the ambidextrous bolt release lever 140 comprises a curved or beveled surface having surface preparations and/or textures so as to provide gripping surface areas. The ambidextrous bolt release lever 140 is formed so as to be releasably attached or coupled to the connector bar 120 proximate the second end portion of the connector bar 120. In various exemplary embodiments, the ambidextrous bolt release lever 140 further comprises a lever projection 141 formed so as to interact with the first connector bar recess 121 of the connector bar 120 to aid in maintaining the connector bar 120 in a determined position relative to the ambidextrous bolt release lever 140.

In certain exemplary, nonlimiting embodiments, the ambidextrous bolt release lever 140 is formed so as to interact with a lever block 145. The lever block 145, if included, fits within at least a portion of the ambidextrous bolt release lever 140 so as to further secure the second end portion of the connector bar 120 to the ambidextrous bolt release lever 140. The lever block 145 comprises a lever block recess 147 formed so as to interact with the second connector bar recess 122 of the connector bar 120.

The lever block 145 can be removably attached or coupled to at least a portion of the ambidextrous bolt release lever 140 by interaction of an attachment screw 160 threadedly attached or coupled through the aligned ambidextrous bolt release aperture 142 and the lever block aperture 149.

The magazine release connection shaft 156 joins the magazine release 155 to the magazine release button 150. The magazine release button 150 is formed so as to be a partially received within the magazine release button recess 250 of the lower receiver 200. The magazine release button 150 and the magazine release 155 are interconnected so as to be installed within the magazine release button aperture 250 of the lower receiver 200 such that manipulation of the magazine release button 150 manipulates the magazine release 155. Manipulation of the magazine release button 150 manipulates the magazine release 155 such that the magazine engagement projection 158 of the magazine release 155 selectively secures a magazine within the magazine well of the lower receiver 200, as with known magazine release buttons and magazine releases. Typically, a magazine release button spring 159 is installed within the magazine release button recess 250 so as to bias the magazine release button 150 to an engaged position.

In various exemplary embodiments, the magazine release connection shaft 156 includes a connection shaft recess 157 formed in a portion of the magazine release connection shaft 156, which allows at least a portion of the connector bar 120 and the biasing rod 130 to be positioned within the lower receiver 200, within the connection shaft recess 157 of the magazine release connection shaft 156. The connection shaft recess 157 is formed so as to allow the magazine release connection shaft 156 to move a sufficient distance to allow the magazine release 155 and the magazine release button 150 to operate without interfering with the connector bar 120 and the biasing rod 130 or the operation of the connector bar 120 and the biasing rod 130.

In various exemplary embodiments, various components of the ambidextrous bolt release system 100 are substantially rigid and are formed of metal. Alternate materials of construction of the various components of the ambidextrous bolt release system 100 may include one or more of the following: wood, steel, stainless steel, aluminum, titanium, and/or other metals, as well as various alloys and composites thereof, plastic, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the various components of the ambidextrous bolt release system 100 is a design choice based on the desired appearance and functionality of the ambidextrous bolt release system 100.

It should be appreciated that certain elements of the ambidextrous bolt release system 100 may be formed as an integral unit. Alternatively, suitable materials can be used and sections or elements made independently and attached or coupled together, such as by adhesives, welding, screws, rivets, pins, or other fasteners, to form the various elements of the ambidextrous bolt release system 100.

FIGS. 1-4, 6, 8, and 10 most clearly illustrate the ambidextrous bolt release system 100, while FIGS. 5, 7, 9, and 11-24 most clearly illustrate the ambidextrous bolt release system 100 installed within the ambidextrous lower receiver 200. As illustrated, during installation, the magazine release button 150 is attached or coupled within at least a portion of the magazine release button recess 250, while the magazine release 155 is attached or coupled within at least a portion of the magazine release recess 255 of the lower receiver 200. In a typical fashion, the magazine release button 150 is attached or coupled to the magazine release 155 by a threaded interaction of a threaded aperture of the magazine release button 150 and a threaded portion of the magazine release connection shaft 156.

The connector bar 120 is then positioned within a connector bar channel 220. The connector bar channel 220 is formed within lower receiver 200, between the trigger guard aperture 204 and the bolt catch recess 210. The connector bar channel 220 is formed so as to allow the connector bar 120 to freely move within the connector bar channel 220, along the longitudinal axis of the connector bar 120.

When the connector bar 120 is appropriately positioned, and at least a portion of the second end portion of the connector bar 120 extends through the connector bar channel 220 and into the ambidextrous bolt release lever recess 244. The ambidextrous bolt release lever 140 is attached or coupled to the connector bar 120 proximate the second end portion of the connector bar 120.

In various exemplary, nonlimiting embodiments, wherein the lever block 145 is included, the lever block 145 is engaged horizontally from a side of the lower receiver 200 and positioned, within the ambidextrous bolt release lever recess 244, about the connector bar 120 such that the second connector bar recess 122 is positioned within the lever block recess 147. The ambidextrous bolt release lever 140 is then also positioned within the trigger guard aperture 204, within the ambidextrous bolt release lever recess 244, such that at least a portion of the lever projection 141 is received within the connection bar first connector bar recess 121, such that the ambidextrous bolt release aperture 142 is aligned with the lever block aperture 149. An attachment screw 160 is then optionally utilized to further attach or couple the ambidextrous bolt release lever 140 to the lever block 145, via the ambidextrous bolt release aperture 142 in the lever block aperture 149.

An optional spring detent 138 and biasing spring 136 are positioned within a portion of the connector bar channel 220 such that the spring detent 138 and or a bottom portion of the biasing spring 136 rest on the connector bar shoulder 124. The biasing rod 130 is secured in a desired position within a portion of the connector bar channel 220 via the biasing rod threaded detent 132. By adjusting the spring bias of the biasing spring 136 and/or the positioning of the biasing rod 130 within the connector bar channel 220, the ambidextrous bolt release lever 140 can be biased to a determined position for movement along the ambidextrous bolt release lever guide 242 within the trigger guard aperture 204. In various exemplary embodiments, the ambidextrous bolt release lever 140 is biased to a neutral position such that the ambidextrous bolt release lever 140 can be urged either upward or downward, within the trigger guard aperture 204.

In various exemplary embodiments, the ambidextrous bolt release lever guide 242 comprises a dovetail style projection that is capable of interacting with a mating dovetail recess formed in the ambidextrous bolt release lever 140. Alternatively, the ambidextrous bolt release lever guide 242 may comprise a projection or overall shape that allows engagement and interaction with a mating recess formed within at least a portion of the ambidextrous bolt release lever 140 and/or the combination of the ambidextrous bolt release lever 140 and the lever block 145. The ambidextrous bolt release lever guide 242 comprises a guide that maintains the ambidextrous bolt release lever 140 in a determined side to side, or horizontal, position relative to the trigger guard aperture 204 and/or the lower receiver 200.

The bolt catch 110 is positioned within the bolt catch recess 210 such that at least a portion of the bolt catch projection 119 is fitted within the connector bar hook 126 of the connector bar 120. The bolt catch 110 is then rotatably coupled or attached to the lower receiver 200 in the typical fashion, via insertion of a role pin through the bolt catch pivot aperture 114.

Once installed, the ambidextrous bolt release lever 140 is positioned within at least a portion of a trigger guard aperture 204 of a firearm, the connector bar 120 is attached or coupled to the bolt catch 110 via interaction of a connector bar hook 126 of the connector bar 120 and a bolt catch projection 119 of the bolt catch 110, the connector bar 120 is attached or coupled to the ambidextrous bolt release lever 140 via interaction of a connector bar first connector bar recess 121 of the connector bar 120 and a lever projection 141 of the ambidextrous bolt release lever 140, and the ambidextrous bolt release lever 140 is spring biased via interaction of a biasing rod 130 and a biasing spring 136 on the shoulder 124 of the connector bar 120.

Thus, the lower receiver 200 having an ambidextrous bolt release system 100 includes an ambidextrous bolt release lever 140; a bolt catch 110 pivotable about a bolt catch pivot aperture 114 between a bolt engagement and a bolt release position, wherein the bolt catch 110 comprises a bolt engagement projection 116, and wherein the bolt catch 110 comprises a bolt catch projection 119; and a connector bar 120 extending from a first end portion to a second end portion and attached or coupled between the ambidextrous bolt release lever 140 and the bolt catch 110, such that vertical movement of the ambidextrous bolt release lever 140 results in vertical movement of the connector bar 120 and rotation of the bolt catch 110.

It should be appreciated that a more detailed explanation of the components of the lower receiver 200 and certain other items and/or techniques necessary for the implementation and/or operation of the various components of the AR-15 platform are not provided herein because such background information will be known to one of ordinary skill in the art. Therefore, it is believed that the level of description provided herein is sufficient to enable one of ordinary skill in the art to understand and implement the system as described.

During use, when the ambidextrous bolt release lever 140 is urged upward, along the ambidextrous bolt release lever guide 242, interaction between the ambidextrous bolt release lever 140 and the connector bar 120, via, for example, interaction between the lever projection 141 and the first connector bar recess 121, urges the connector bar 120 upward, against the spring bias supplied by the biasing spring 136. As the connector bar 120 is urged upward, the connector bar hook 126 interacts with the bolt catch projection 119, rotating the bolt catch 110, about the bolt catch pivot aperture 114, from a neutral position to the bolt engagement position.

Alternatively, when the ambidextrous bolt release lever 140 is urged downward along the ambidextrous bolt release lever guide 242, interaction between the ambidextrous bolt release lever 140 and the connector bar 120, via, for example, interaction between the lever projection 141 and the first connector bar recess 121, urges the connector bar 120 upward. As the connector bar 120 is urged upward, the connector bar hook 126 interacts with the bolt catch projection 119, rotating the bolt catch 110, about the bolt catch pivot aperture 114, from a neutral position to the bolt release position.

Since the ambidextrous bolt release lever 140 can be accessed equally as easily from the right side of the lower receiver 200 as the left side of the lower receiver 200, the present disclosure provides a truly ambidextrous bolt release system for a firearm.

While the presently disclosed systems, methods, and/or apparatuses have been described in conjunction with the exemplary embodiments outlined above, the foregoing description of exemplary embodiments, as set forth above, are intended to be illustrative, not limiting and the fundamental disclosure should not be considered to be necessarily so constrained. It is evident that the disclosure is not limited to the particular variation set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the disclosure. The upper and lower limits of these smaller ranges may independently be included in the smaller ranges and is also encompassed within the disclosure, subject to any specifically excluded limit in the stated range. Where the stated range includes one or both of the limits, ranges excluding either or both of those included limits are also included in the disclosure.

It is to be understood that the phraseology of terminology employed herein is for the purpose of description and not of limitation. Unless defined otherwise, all technical and scientific terms used herein have the same meaning as commonly understood by one of ordinary skill in the art to which this disclosure belongs.

In addition, it is contemplated that any optional feature of the inventive variations described herein may be set forth and claimed independently, or in combination with any one or more of the features described herein.

Accordingly, the foregoing description of exemplary embodiments will reveal the general nature of the disclosure, such that others may, by applying current knowledge, change, vary, modify, and/or adapt these exemplary, non-limiting embodiments for various applications without departing from the spirit and scope of the disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the disclosure.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. An ambidextrous bolt release, comprising:

(a) an ambidextrous bolt release lever;

(b) a bolt catch pivotable about a bolt catch pivot aperture between a bolt engagement and a bolt release position, wherein said bolt catch comprises a bolt engagement projection, and wherein said bolt catch comprises a bolt catch projection; and (c) a connector bar extending from a first end portion to a second end portion and attached or coupled between said ambidextrous bolt release lever and said bolt catch, such that vertical movement of said ambidextrous bolt release lever results in vertical movement of said connector bar and rotation of said bolt catch.

2. The ambidextrous bolt release of claim 1, wherein said connector bar is attached or coupled to said bolt catch via interaction of a connector bar hook of said connector bar and a bolt catch projection of said bolt catch.

3. The ambidextrous bolt release of claim 1, wherein said connector bar is attached or coupled to said ambidextrous bolt release lever via interaction of a connector bar primary recess of said connector bar and a lever projection of said ambidextrous bolt release lever.

4. The ambidextrous bolt release of claim 1, wherein said ambidextrous bolt release lever is spring biased via interaction of a biasing rod and a biasing spring on a shoulder of said connector bar.

5. The ambidextrous bolt release of claim 1, wherein said ambidextrous bolt release lever is positioned within at least a portion of a trigger guard aperture of a firearm.

6. An ambidextrous bolt release, comprising:

(a) an ambidextrous bolt release lever positioned within at least a portion of a trigger guard aperture of a firearm;

(b) a bolt catch pivotable about a bolt catch pivot aperture between a bolt engagement and a bolt release position, wherein said bolt catch comprises a bolt engagement projection, and wherein said bolt catch comprises a bolt catch projection; and (c) a connector bar extending from a first into a second end portion and attached or coupled between said ambidextrous bolt release lever and said bolt catch, such that vertical movement of said ambidextrous bolt release lever results in vertical movement of said connector bar and rotation of said bolt catch.

7. An ambidextrous bolt release, comprising:

(a) a bolt catch, wherein a bolt catch projection extends from a surface of said bolt catch;

(b) a connector bar, wherein said connector bar extends from a first end portion to a second end portion, wherein said connector bar further comprises a connector bar hook having a connector bar recess formed proximate said first end portion, and wherein said bolt catch projection is capable of interacting with said connector bar recess;

(c) a biasing rod, wherein said biasing rod extends from a first end portion to a second end portion; and (d) an ambidextrous bolt release lever, wherein said ambidextrous bolt release lever is releasably attached or coupled to said connector bar proximate said second end portion of said connector bar.

8. The ambidextrous bolt release of claim 7, wherein said connector bar further comprises a first connector bar recess formed proximate said second end portion and a second connector bar recess formed proximate said second end portion.

9. The ambidextrous bolt release of claim 7, wherein said bolt catch projection is capable of interacting with said connector bar recess such that longitudinal movement of said connector bar produces rotational movement of said bolt catch.

10. The ambidextrous bolt release of claim 7, wherein a shoulder is formed in said connector bar, proximate said second end portion, for engaging a biasing spring and/or a spring detent.

11. The ambidextrous bolt release of claim 7, wherein said biasing rod further comprises a biasing rod dimple or recess formed so as to be at least partially engaged by a biasing rod threaded detent for being secured within at least a portion of a bolt catch aperture of a lower receiver.

12. The ambidextrous bolt release of claim 7, wherein a biasing spring provides a biasing force to said biasing rod.

13. The ambidextrous bolt release of claim 7, wherein said ambidextrous bolt release lever comprises a curved or beveled surface.

14. The ambidextrous bolt release of claim 7, wherein said ambidextrous bolt release lever comprises one or more surface preparations and/or textures to provide gripping surface portions.

15. The ambidextrous bolt release of claim 7, wherein said ambidextrous bolt release lever further comprises a lever projection formed to interact with a first connector bar recess of said connector bar.

16. The ambidextrous bolt release of claim 7, wherein said ambidextrous bolt release lever is releasably attached or coupled to said connector bar via a lever block, wherein said lever block fits within at least a portion of said ambidextrous bolt release lever so as to further secure said second end portion of said connector bar to said ambidextrous bolt release lever.

17. The ambidextrous bolt release of claim 7, further comprising:

(e) a magazine release having a magazine release connection shaft comprising a connection shaft recess formed in a portion of said magazine release connection shaft, wherein said connection shaft recess allows said connector bar and said biasing rod to operate adjacent to said magazine release connection shaft without interference from said magazine release connection shaft.

18. The ambidextrous bolt release of claim 7, wherein said ambidextrous bolt release is installed within a lower receiver.

19. The ambidextrous bolt release of claim 18, wherein at least a portion of said connector bar is positioned within at least a portion of a connector bar channel of said lower receiver.

20. The ambidextrous bolt release of claim 18, wherein at least a portion of said biasing rod is secured within at least a portion of a connector bar channel of said lower receiver.

* * * * *